US011910942B2

(12) United States Patent
Watkins

(10) Patent No.: US 11,910,942 B2
(45) Date of Patent: Feb. 27, 2024

(54) CUP WITH STORAGE COMPARTMENT

(71) Applicant: Libby Watkins, Frisco, TX (US)

(72) Inventor: Libby Watkins, Frisco, TX (US)

( * ) Notice: Subject to any disclaimer, the term of this patent is extended or adjusted under 35 U.S.C. 154(b) by 314 days.

(21) Appl. No.: 17/197,273

(22) Filed: Mar. 10, 2021

(65) Prior Publication Data

US 2022/0287485 A1 Sep. 15, 2022

(51) Int. Cl.
*A47G 19/22* (2006.01)
*B65D 83/04* (2006.01)

(52) U.S. Cl.
CPC ..... *A47G 19/2205* (2013.01); *B65D 83/0481* (2013.01)

(58) Field of Classification Search
CPC .. B65D 51/28; B65D 2231/022; B65D 25/04; B65D 1/265; A47G 19/2205; A47G 19/30; A47G 19/23; A47G 23/03
USPC ..... 220/212, 23.86, 521, 23.83; 206/217
See application file for complete search history.

(56) References Cited

U.S. PATENT DOCUMENTS

| | | | | |
|---|---|---|---|---|
| 4,795,028 | A * | 1/1989 | Wittig | B65D 81/3205 206/217 |
| 5,531,353 | A * | 7/1996 | Ward | A47J 41/0083 220/729 |
| 8,381,935 | B1 | 2/2013 | Buck | |
| 9,622,605 | B2 | 4/2017 | Buck | |
| 2004/0149598 | A1 | 8/2004 | Scarla | |
| 2011/0168719 | A1 | 7/2011 | Lotterhos | |
| 2011/0210126 | A1 | 9/2011 | Vovan | |

* cited by examiner

*Primary Examiner* — King M Chu
(74) *Attorney, Agent, or Firm* — Southern Methodist University Dedman School of Law

(57) ABSTRACT

A device includes a cup having an open top, an interior bottom and an exterior bottom, a compartment coupled to the exterior bottom of the cup, and a removable film coupled to the compartment. The cup may be operable to hold a liquid. The compartment may be operable to hold an item, and the removable film may be operable to expose the item.

20 Claims, 13 Drawing Sheets

CUP WITH STORAGE COMPARTMENT

TECHNICAL FIELD

This disclosure relates generally to a storage device, and more particularly to a storage compartment on the bottom of a cup.

BACKGROUND

One of the leading causes of bad breath amongst working individuals is coffee. For many people, coffee is needed to keep them functioning at a high level throughout the day. Consequently, the more coffee a person drinks, often the worse their breath will become. A mint or breath freshener is a solution to this problem. However, coffee and breath fresheners are rarely ever found in the same vicinity.

SUMMARY

In accordance with the present disclosure, a cup with a storage compartment is provided which substantially eliminates or reduces disadvantages and problems associated with previous systems and methods.

In accordance with one aspect of the present disclosure, a system is provided for a cup having an open top, an interior bottom, and an exterior bottom. The exterior bottom of the cup could be enclosed by a film to create a compartment that can hold an item. The compartment can be exposed when the film is removed. Thus, allowing the item to be withdrawn. More specifically, the present disclosure also includes a cup that is disposable. Moreover, the film can cover at least a portion of the bottom or side surface of the compartment. This film is meant to be either peeled off or punctured to expose the item.

In accordance with another aspect of the present disclosure, a system is provided for a cup with an openable compartment on the bottom. This compartment is used to provide storage. Moreover, the present disclosure also includes a cup that is meant to be used multiple times. In some implementations, the compartment is detachable from the cup. It can detach by being unscrewed or with the use of magnets attached to the cup and the compartment that can be pulled apart. In another implementation, the compartment could have a hinge attached to it that would allow it to pivot away from the cup to expose the compartment. Furthermore, the compartment could have a sliding cover on the bottom or side of the cup that could be slid to expose the interior of the compartment. Additionally, in another implementation, the compartment could contain a gear that rotates, secure an item within one of its pegs, and then bring the item to an aperture in the side of the container.

Furthermore, in accordance with another aspect of the present disclosure, a system is provided a cup that has a means for storing an item in the cup. The present disclosure also includes a means for retrieving the item that is stored in the cup.

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of the present disclosure and its advantages, reference is now made to the following description taken in conjunction with the accompanying drawings, in which like reference numbers indicate like features, and.

DETAILED DESCRIPTION

Figure 1A:
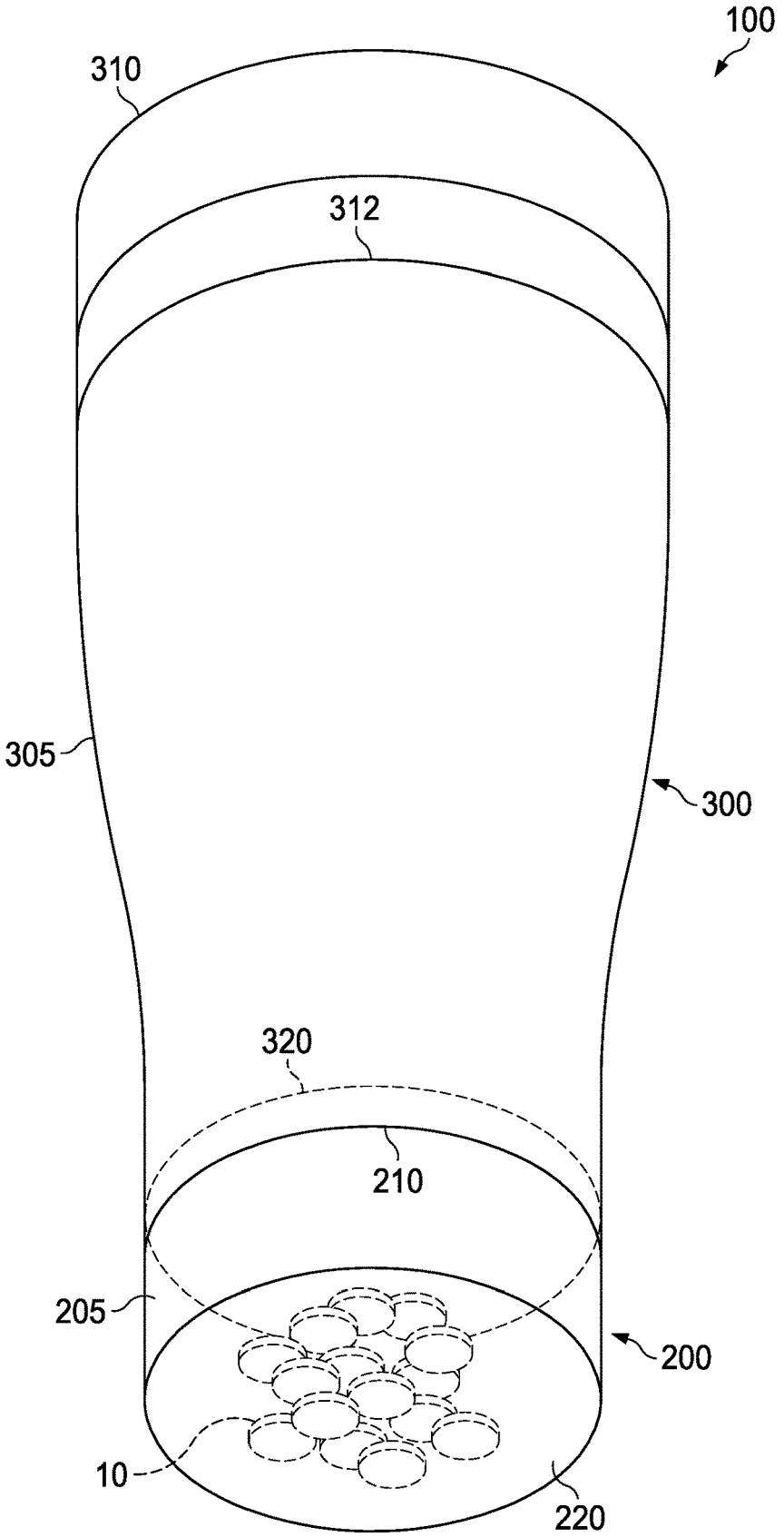
FIG. 1A illustrates a perspective view, looking upwardly from the bottom, of a cup with an attached but separate storage compartment on the bottom of it according to the present disclosure.

FIG. 1A-8B depict various implementations of storage cups, each comprising a storage compartment and a cup portion that form separate containers within the storage cup. Thus, the storage cup may be operable to store one or more items in its storage compartment, such as the items 10 shown in FIG. 1A, FIG. 7A, FIG. 7B, FIG. 8A and FIG. 8B, separate from a liquid or other substance that may be contained in the cup portion. Representative but non-limiting examples of items that may be stored in a storage compartment include a mint, a vitamin, a pill, a piece of candy, or any other item that can fit within the storage compartment and that can be retrieved or dispensed according to the operation of a specific storage compartment. In the descriptions that follow, like reference numerals in the various drawings indicate like elements.

Figure 1B:
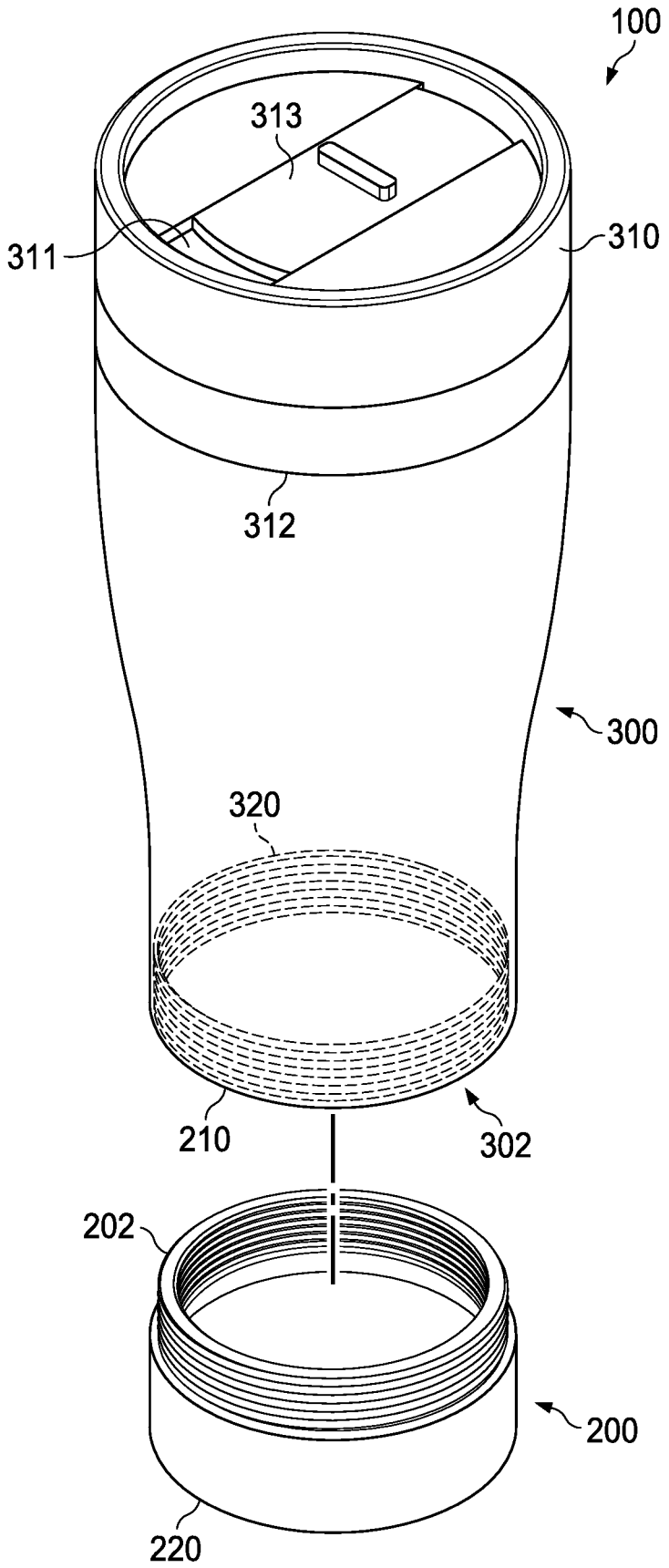
FIG. 1B illustrates a perspective view, looking downwardly from the top, of FIG. 1A after the storage compartment has been unscrewed from the bottom of the cup.

FIG. 1A and FIG. 1B illustrate perspective views of one implementation of a non-disposable storage cup 100, showing a storage compartment 200 of the storage cup 100 in a coupled and an uncoupled configuration, respectively. In more detail, storage cup 100 comprises a generally disk-shaped storage compartment 200 at the bottom of the storage cup 100, and a cylindrical cup portion 300 disposed above the storage compartment 200. Referring first to FIG. 1A, the storage compartment 200 comprises a generally disk-shaped body 205 with a bottom 220 operable to contain items 10 disposed within the storage compartment 200, as well as protect those items 10 from the outside environment. The storage compartment 200 couples to the cup portion 300 via a divider 210 operable to create a seal between the storage compartment 200 and the cup portion 300. The cup portion 300 comprises a generally cylindrical body 305 with a barrier 320 at a lower portion thereof, the body 305 operable for holding liquid or another substance separate from the storage compartment 200. The body 305 of the cup portion 300 further comprises a lip 312 at an upper portion thereof. In an implementation, the lip 312 couples with and forms a seal with an optional removable lid 310 for retaining liquid or other substance within the cup portion 300.

Referring now to FIG. 1B, a perspective view of the storage cup 100 of FIG. 1A is illustrated with the generally disk-shaped storage compartment 200 at the bottom of the storage cup 100 uncoupled from the cylindrical cup portion 300. As depicted, in this implementation, divider 210 comprises a threaded end 202 at an upper end of storage compartment 200 designed to engage with a threaded receiver 302 on a lower end of cup portion 300. Thus, threaded end 202 is operable to uncouple from threaded receiver 302 to allow storage compartment 200 to uncouple from cup portion 300 to expose the interior of storage compartment 200 as shown in FIG. 1B. Additionally, threaded end 202 is operable to couple with threaded receiver 302 to allow storage compartment 200 to couple with cup portion 300 to enclose the contents of storage compartment 200 as shown in FIG. 1A. By twisting storage compartment 200 either counterclockwise or clockwise with respect to cup portion 300, storage compartment 200 can couple or uncouple from cup portion 300 via threaded end 202 interacting with threaded receiver 302. Still referring to FIG. 1B, lid 310 may optionally include a lid slider 313, which is used to open or close a lid opening 311 in the lid 310, and thereby expose or enclose a liquid contained in cup portion 300 from the exterior environment.

Figure 2:
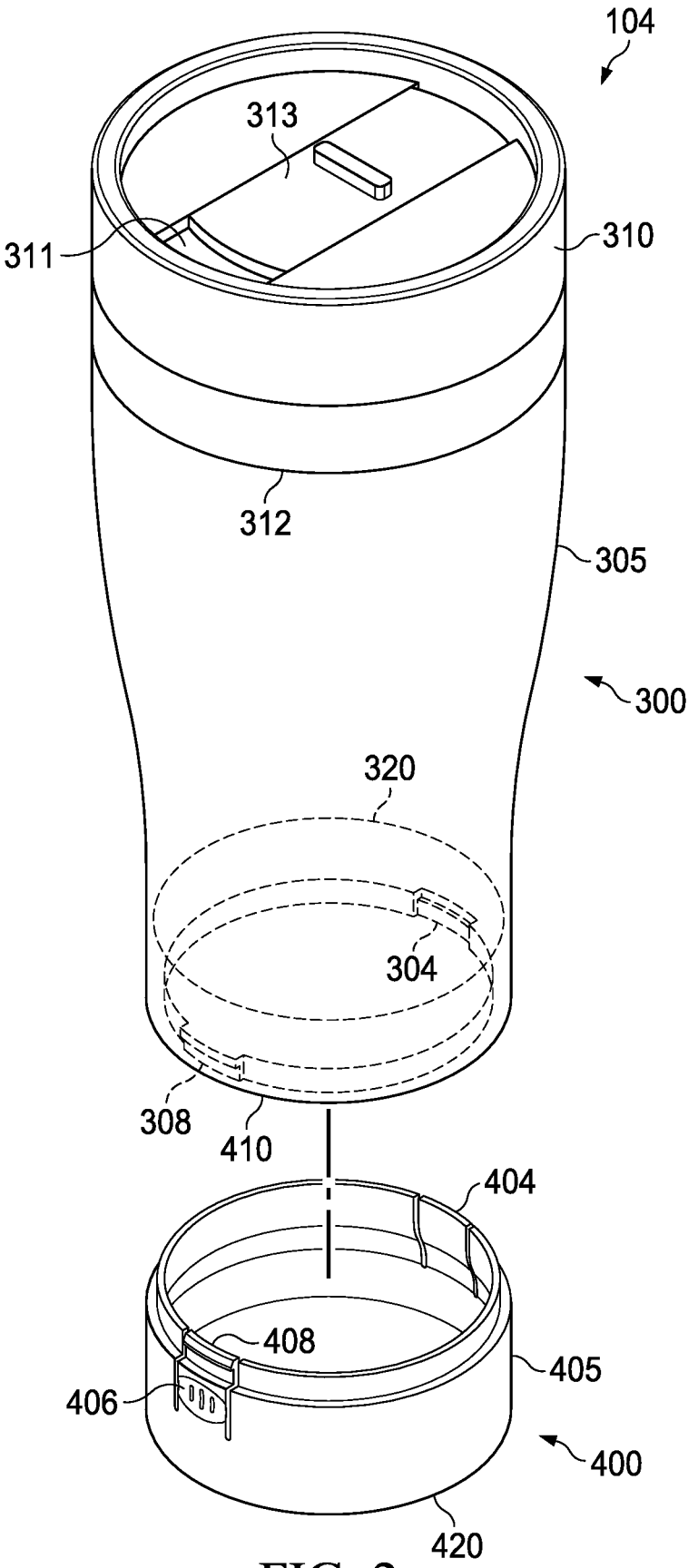
FIG. 2 illustrates a perspective view, looking downwardly from the top, of a cup with an unattached storage compartment with a latch locking system.

Referring now to FIG. 2, a perspective view of another implementation of a non-disposable storage cup 104 is illustrated with a storage compartment 400 at the bottom of the storage cup 104 uncoupled from the cylindrical cup portion 300. The storage compartment 400 comprises a generally disk-shaped body 405 with a bottom 420. As depicted, in this implementation, a divider 410 comprises a release latch 404 on the body 405 of the storage compartment 400 designed to engage with a corresponding latch lock 304 on the body 305 of the cup portion 300. In more detail, release latch 404 comprises a latch portion 408 coupled to a release button 406, and latch lock 304 comprises a receiver 308. When the release latch 404 and the latch lock 304 are engaged, the latch portion 408 of the release latch 404 extends into the receiver 308 of the latch lock 304. To disengage release latch 404 from latch lock 304, the release button 406 is pushed in, and the latch portion 408 of the release latch 404 is thereby withdrawn from the receiver 308 on the latch lock 304, allowing for the storage compartment 400 to be pulled down and separated from the cup portion 300. Thus, release latch 404 is operable to uncouple from latch lock 304 to allow storage compartment 400 to uncouple from cup portion 300 to expose the interior of storage compartment 400 as shown in FIG. 2. Additionally, release latch 404 is operable to couple with latch lock 304 to allow storage compartment 400 to couple with cup portion 300 to enclose the contents of storage compartment 400 at the bottom of storage cup 104.

Figure 3A:
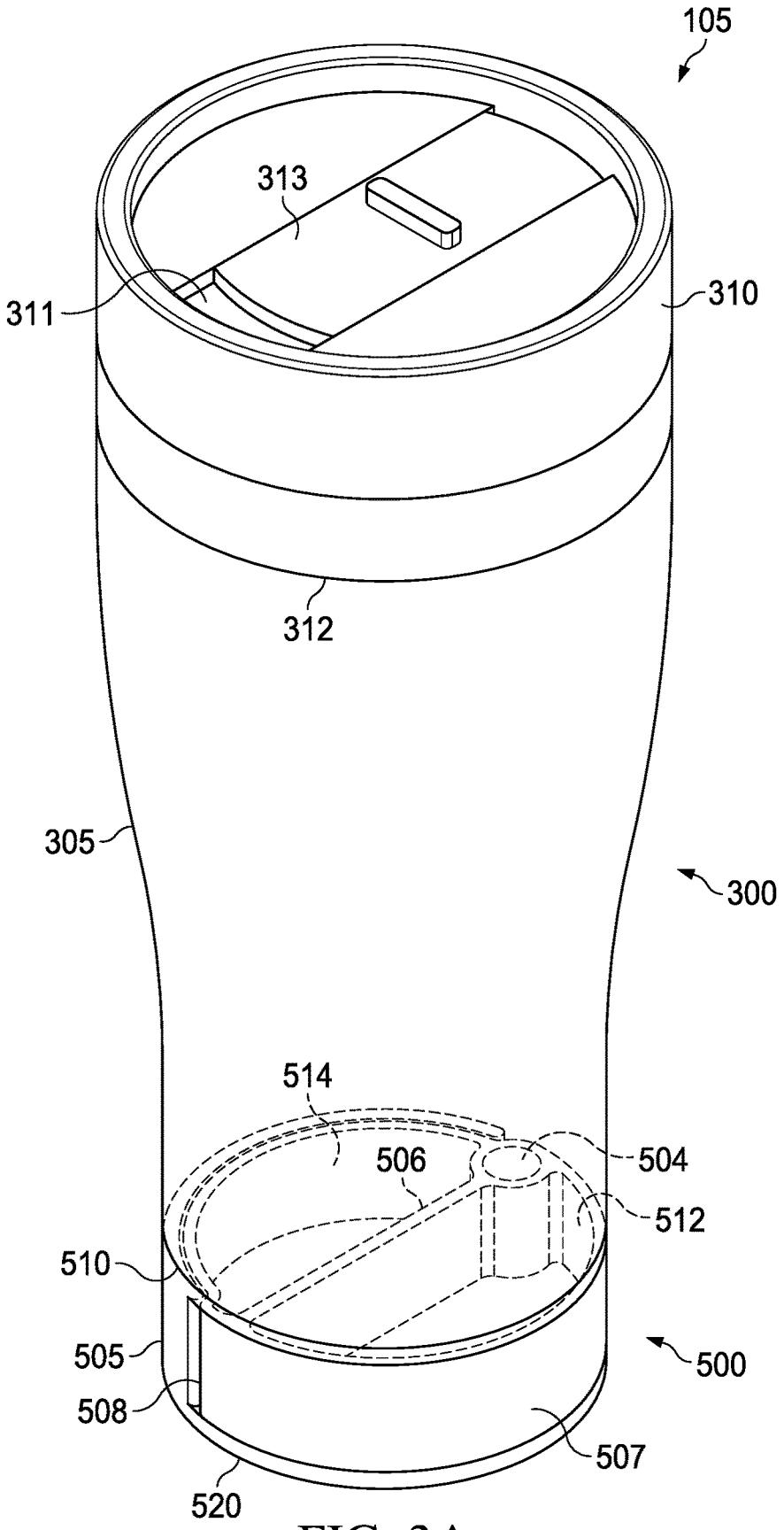
FIG. 3A illustrates a perspective view, looking downwardly from the top, of a cup in which the bottom compartment, which contains an interior hinge, is closed.
Figure 3B:
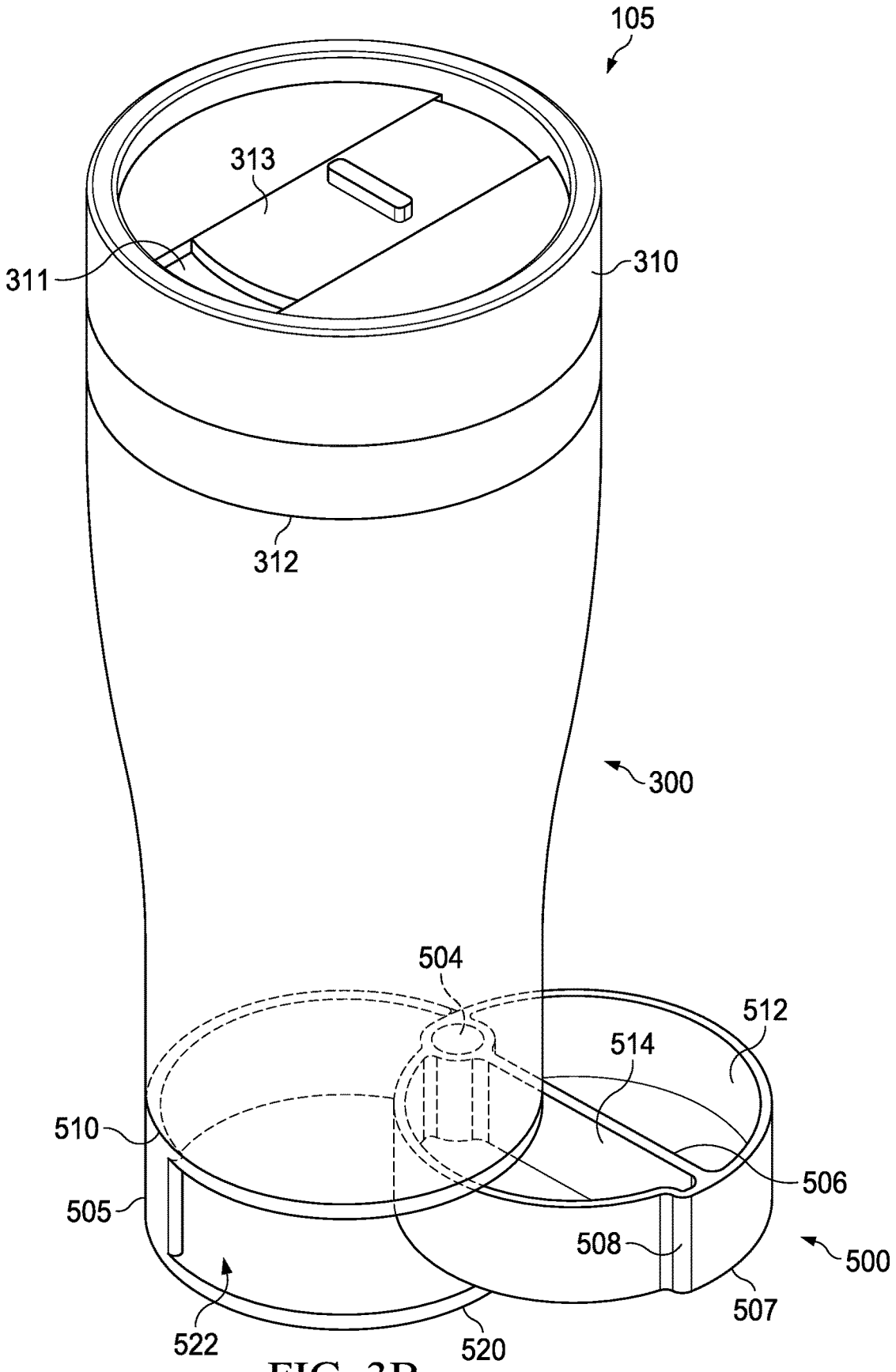
FIG. 3B illustrates the compartment of FIG. 3A pivoted out from the bottom of the cup using a hinge.

FIG. 3A and FIG. 3B illustrate perspective views of another implementation of a non-disposable storage cup 105, showing a storage compartment 500 in a closed configuration and in an open configuration, respectively. In more detail, the storage cup 105 comprises a generally disk-shaped storage compartment 500 at the bottom of the storage cup 105, wherein at least a portion of the storage compartment 500 is rotationally coupled via hinge 504 to the cylindrical cup portion 300. When in the closed configuration shown in FIG. 3A, the storage compartment 500 couples to the cup portion 300 via a divider 510 operable to create a seal between the storage compartment 500 and the cup portion 300. As depicted, in this implementation, the storage compartment 500 comprises a stationary, generally semi-circular chamber wall 505 and a rotational, generally disk-shaped body 507 coupled together via hinge 504. The body 507 further comprises a compartment divider 506 that extends from hinge 504 and divides the interior of the body 507 into segments 512, 514 each operable to hold one or more items; and a grip 508 coupled to disk-shaped body 507 opposite hinge 504. The grip 508 is operable to couple with chamber wall 505 to maintain the body 507 in the closed configuration shown in FIG. 3A. In some embodiments body 507 does not include compartment divider 506.

Operationally, to alter the storage compartment 500 from the open configuration shown in FIG. 3B to the closed configuration shown in FIG. 3A where the disk-shaped body 507 is coupled to chamber wall 505, grip 508 is pushed interiorly and disk-shaped body 507 is pivoted via hinge 504 clockwise, to enclose compartments 512, 514 from the environment. Referring now to FIG. 3B, to alter the storage compartment 500 from the closed configuration shown in FIG. 3A to the open configuration shown in 3B where the disk-shaped body 507 is uncoupled from chamber wall 505, grip 508 is pushed exteriorly and the disk-shaped body 507 is pivoted via hinge 504 counterclockwise, to expose compartments 512, 514 to the environment. In some embodiments body 507 does not include compartment divider 506. As shown in FIG. 3B, in the open configuration, an open space 522 is exposed between the chamber wall 505 and the disk-shaped body 507. The open space 522 is defined by an interior surface of the chamber wall 505 and an interior surface of a bottom 520 of the storage compartment 500. The open space 522 is operable to receive disk-shaped body 507 when chamber wall 505 recouples with disk-shaped body 507 in the closed configuration shown in FIG. 3A.

Figure 4A:
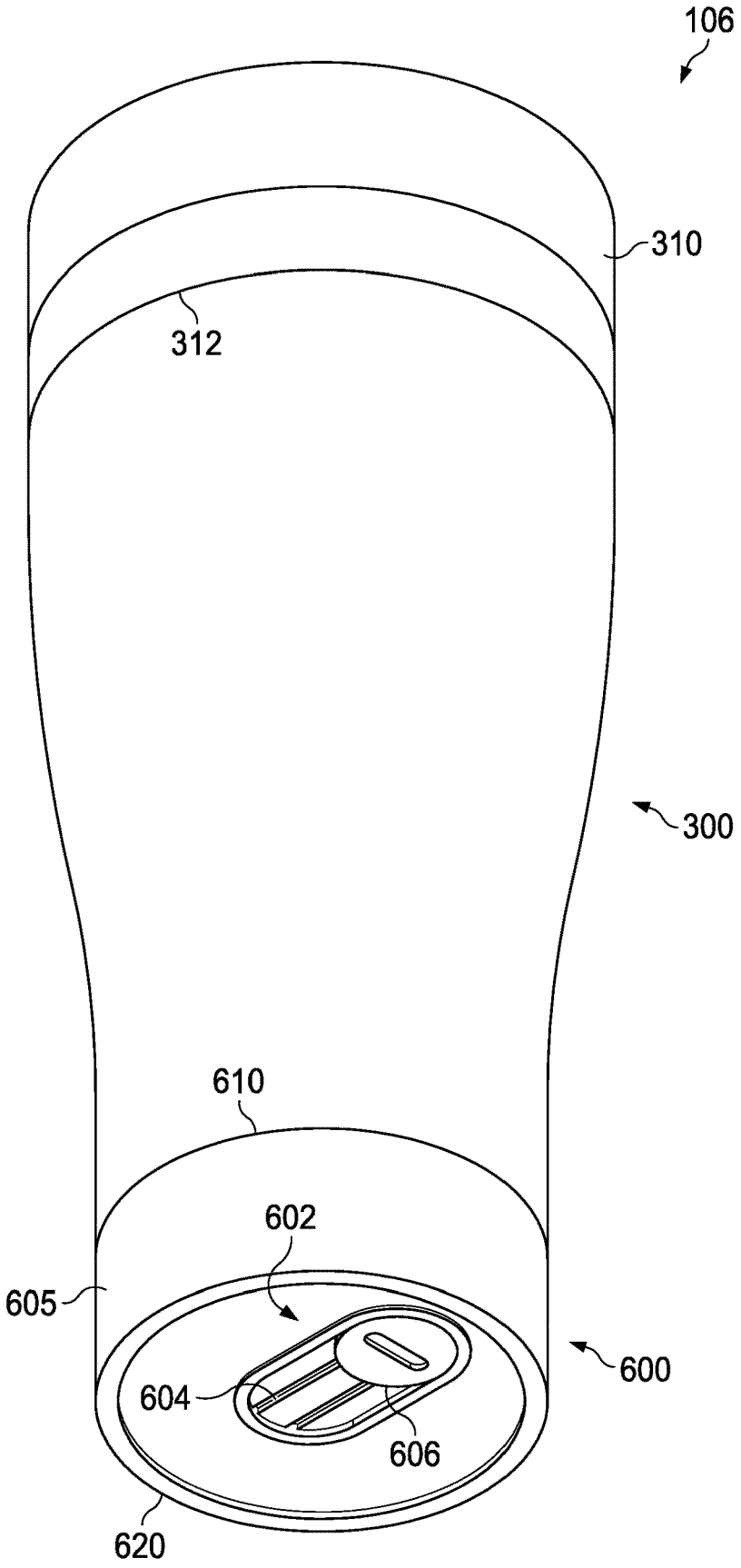
FIG. 4A illustrates a perspective view, looking upwardly from the bottom, of a cup with a fastener on a track in a closed position on the bottom of the compartment.
Figure 4B:
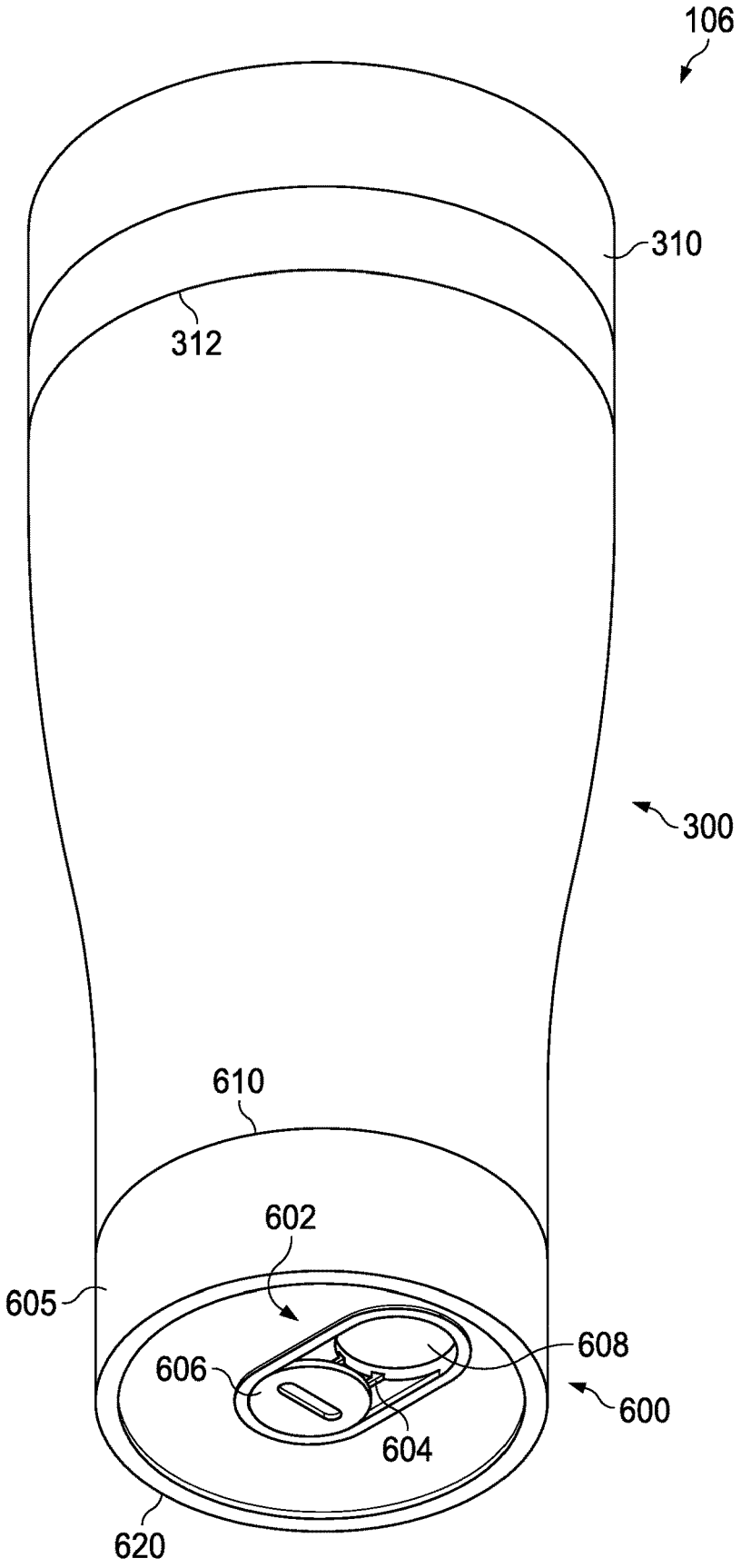
FIG. 4B illustrates a perspective view, looking upwardly from the bottom, of the cup from FIG. 4A with a fastener on a track in an open position on the bottom of the compartment.

FIG. 4A and FIG. 4B illustrate a perspective view of an implementation of a storage cup 106 with a generally disk-shaped storage compartment 600 at the bottom of the storage cup 106 coupled to the cylindrical cup portion 300. The storage compartment 600 couples to the cup portion 300 via a divider 610 operable to create a seal between the storage compartment 600 and the cup portion 300. As depicted, in this implementation, the storage compartment 600 comprises a generally disk-shaped body 605 with a bottom 620 operable to contain storage compartment 600. Additionally, bottom 620 includes a sliding system 602 comprising a sliding track 604 that receives a fastener 606. The sliding system 602 is operable to dispense an item from storage compartment 600 through an opening 608 in the bottom 620 of storage compartment 600. Sliding system 602 operates by pushing fastener 606 from the position shown in FIG. 4A along and toward the opposite end of sliding track 604 in order to reveal the opening 608 in the bottom 620 of storage compartment 600 through which an item may be dispensed from storage compartment 600.

Operationally, to move sliding system 602 from the open configuration shown in FIG. 4B to the closed configuration shown in FIG. 4A, fastener 606 is moved along track 604 to cover the opening 608 in the bottom 620 of storage compartment 600 and thereby enclose compartment 600 from the environment. Similarly, to move sliding system 602 from the closed configuration shown in FIG. 4A to the open configuration shown in FIG. 4B, fastener 606 is moved along track 604 to expose the opening 608 of the compartment 600 to the environment. Referring to FIG. 4B, in the open configuration, the opening 608 is operable to dispense an item that may be stored in compartment 600.

Figure 5A:
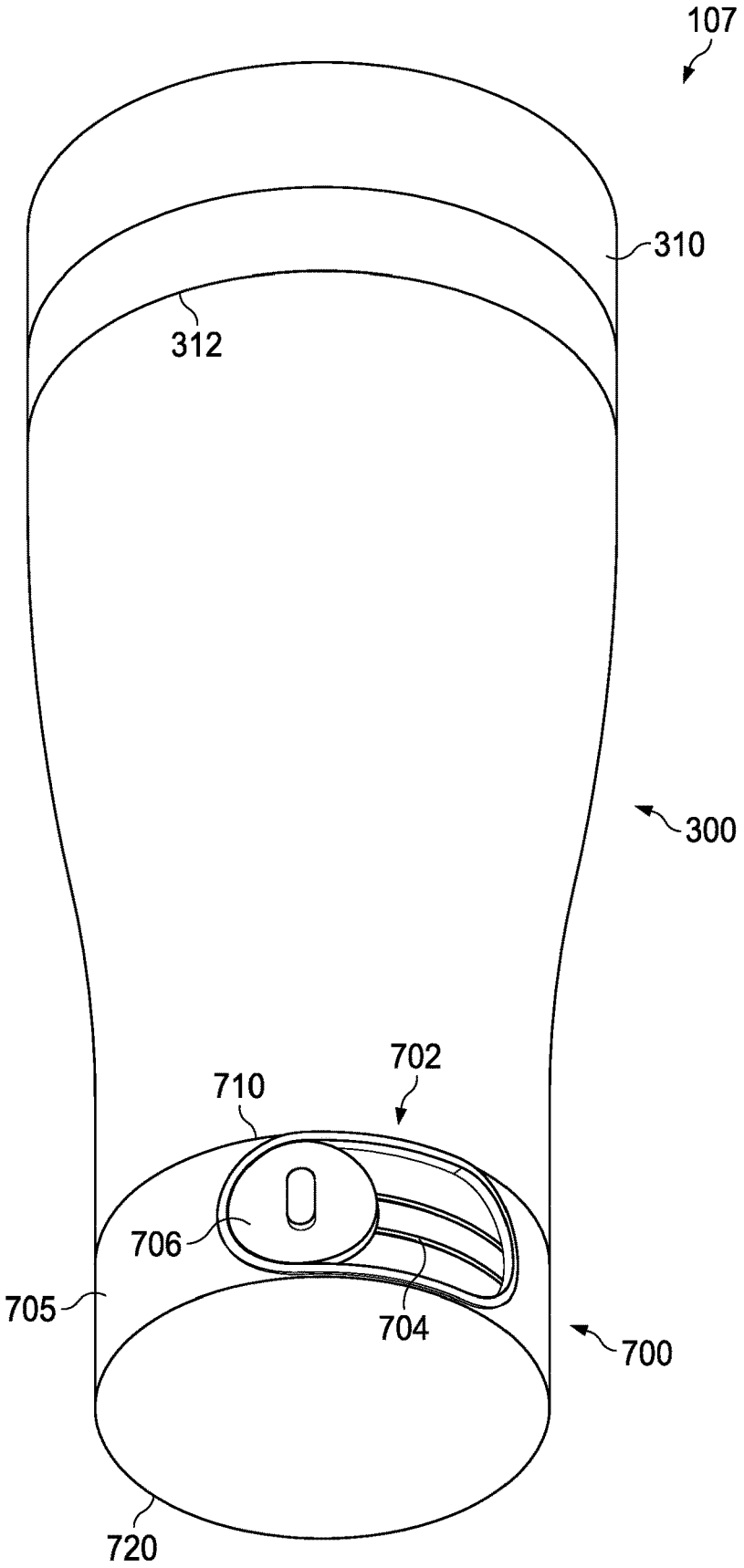
FIG. 5A illustrates a perspective view, looking upwardly from the bottom, of a cup with a fastener on a track in a closed position on the side of the compartment.
Figure 5B:
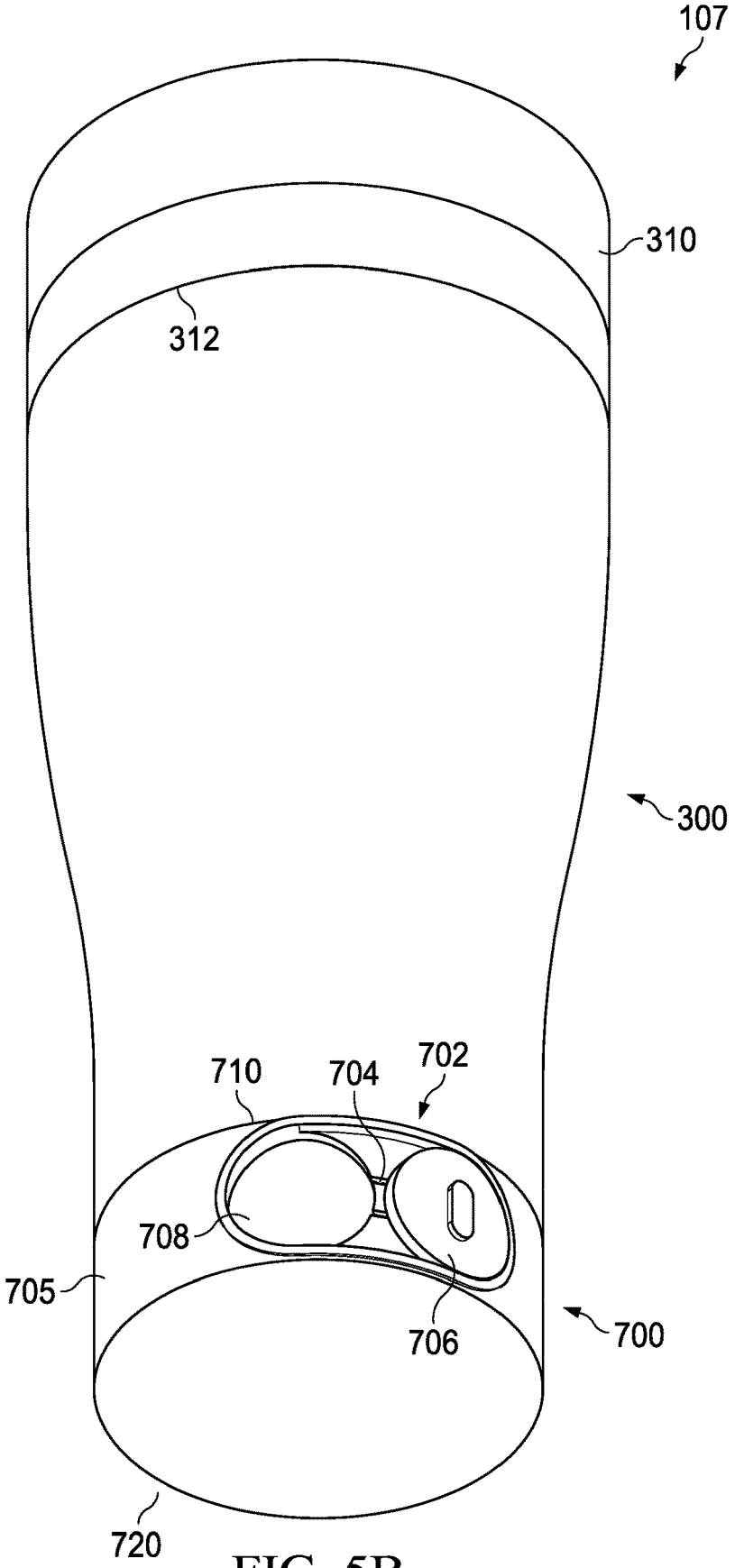
FIG. 5B illustrates a perspective view, looking upwardly from the bottom, of the cup from FIG. 5A with a fastener on a track in an open position on the side of the compartment.

FIG. 5A and FIG. 5B illustrate a perspective view of an implementation of a storage cup 107 with a generally disk-shaped storage compartment 700 at the bottom of the storage cup 107 coupled to the cylindrical cup portion 300. The storage compartment 700 couples to the cup portion 300 via a divider 710 operable to create a seal between the storage compartment 700 and the cup portion 300. As depicted, in this implementation, the storage compartment 700 comprises a generally disk-shaped body 705 with a bottom 720 operable to contain storage compartment 700. Additionally, body 705 includes a sliding system 702 comprising a sliding track 704 that receives a fastener 706. The sliding system 702 is operable to dispense an item from storage compartment 700 through an opening 708 on the exterior of body 705 of storage compartment 700. Sliding system 702 operates by pushing fastener 706 from the position shown in FIG. 5A along and toward the opposite end of sliding track 704 in order to reveal the opening 708 on body 705 of storage compartment 700 through which an item may be dispensed from storage compartment 700.

Operationally, to move sliding system 702 from the open configuration shown in FIG. 5B to the closed configuration shown in FIG. 5A, fastener 706 is moved along track 704 to cover opening 708 and thereby enclose compartment 700 from the environment. Similarly, to move sliding system 702 from the closed configuration shown in FIG. 5A to the open configuration shown in FIG. 5B, fastener 706 is moved along track 704 to expose the opening 708 of the compartment 700 to the environment. Referring to FIG. 5B, in the open configuration, the opening 708 is operable to dispense an item that may be stored in compartment 700.

In an alternative implementation, the sliding system 702 is replaced with a hinge system comprising a hinge that couples to fastener 706 configured to pivot like a door with respect to opening 708. In more detail, the hinge system operates by pivoting fastener 706 via hinge either counterclockwise, from a closed door configuration to an open door configuration, or clockwise, from the open door configuration to the closed door configuration. In the closed door configuration, fastener 706 covers opening 708 and thereby encloses compartment 700 from the environment. Moving to the open door configuration, fastener 706 is pivoted counterclockwise via the hinge to expose the opening 708 of the compartment 700 to the environment. Moving from the open door configuration to the closed door configuration, fastener 706 is pivoted clockwise via the hinge to cover the opening 708 and thereby enclose the compartment 700 from the environment.

Figure 6A:
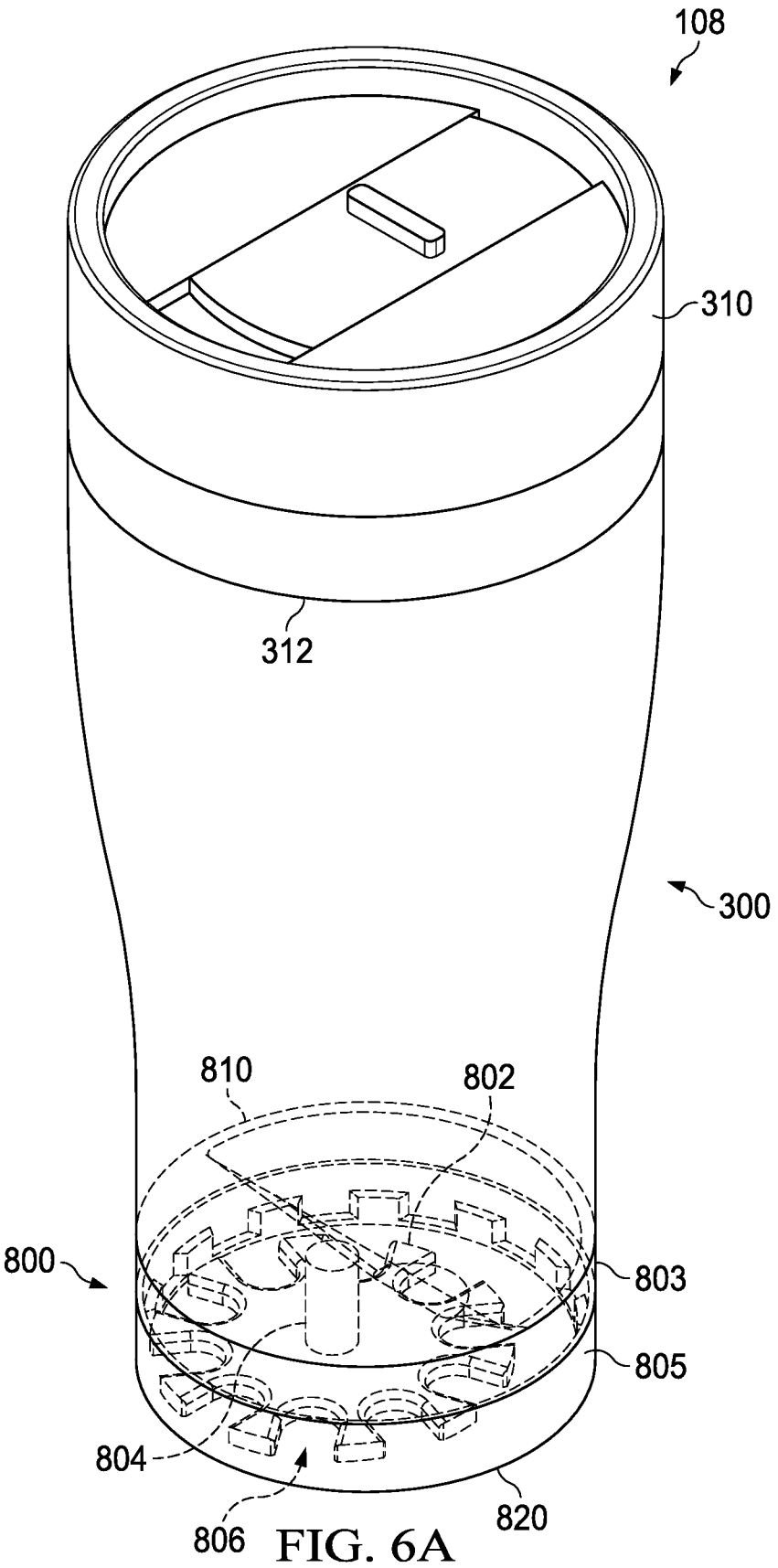
FIG. 6A illustrates a perspective view, looking downwardly from the top, of cup with a bottom compartment that contains a spinning gear inside of it.
Figure 6B:
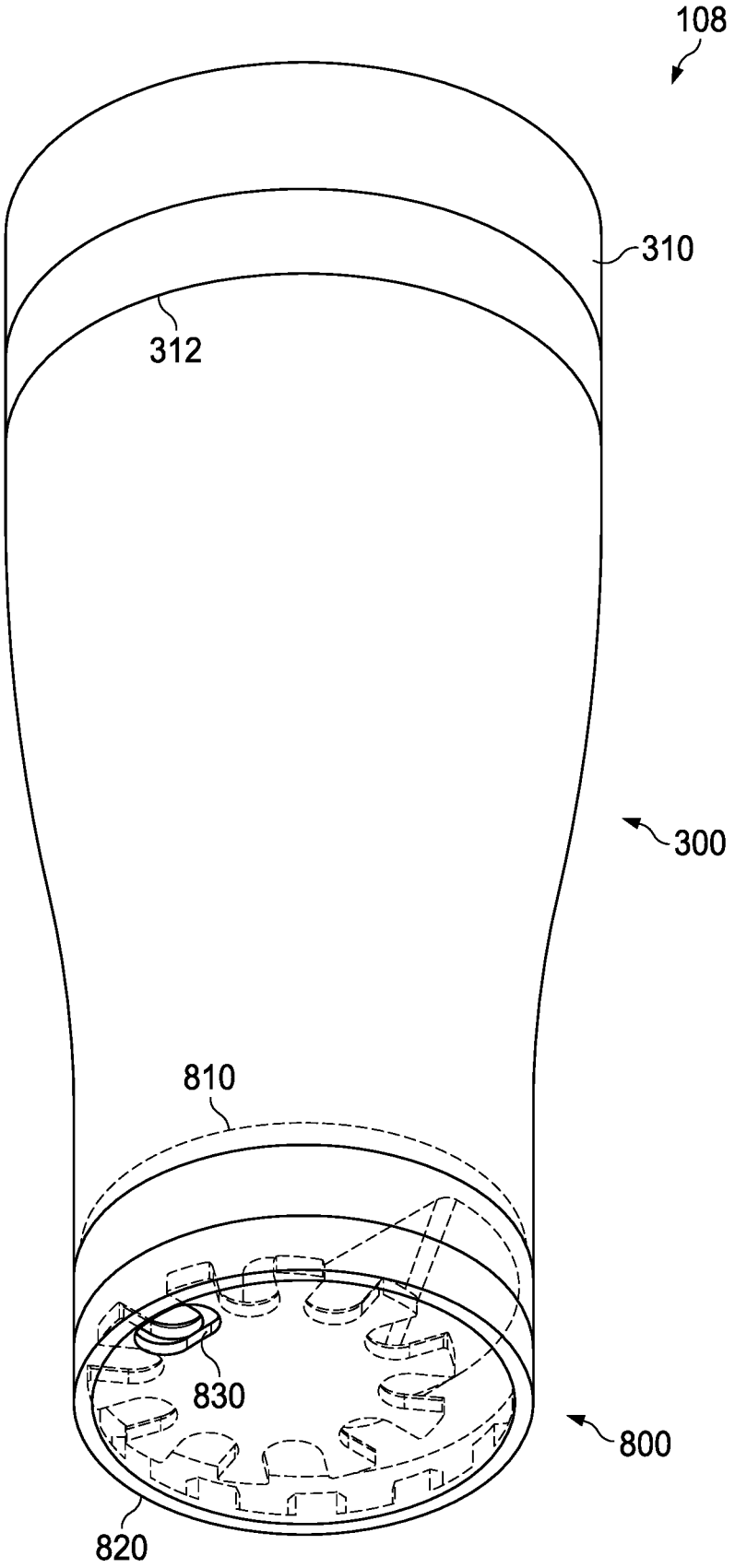
FIG. 6B illustrates a perspective view, looking upwardly from the bottom, of the cup from FIG. 6A with an opening in the bottom.

FIG. 6A and FIG. 6B illustrate a downward perspective view and an upward perspective view, respectively, of another implementation of storage cup 108 with a generally disk-shaped storage compartment 800 at the bottom of the storage cup 108 coupled to the cylindrical cup portion 300. Referring now to FIG. 6A, the storage compartment 800 couples to the cup portion 300 via a divider 810 operable to create a seal between the storage compartment 800 and the cup portion 300. In this implementation, divider 810 may comprise a threaded end (first part) at an upper end of upper body 803 designed to engage with a threaded receiver (second part) on a lower end of cup portion 300. As depicted, in this implementation, the storage compartment 800 comprises a generally disk-shaped upper body 803 rotationally coupled to a generally disk-shaped lower body 805 with a bottom 820 operable to contain storage compartment 800. The bottom 820 of storage compartment 800 further comprises a compartment opening 830.

Storage compartment 800 further comprises a fixed spur 802 coupled to a fixed internal shaft 804 and coupled to the barrier 320 of cup portion 300. Fixed spur 802, which is coupled to shaft 804, remains stationary while lower body 805 may be twisted, either counterclockwise or clockwise, with respect to upper body 803. Fixed spur 802 further comprises a plurality of fixtures 806, each operable to contain an item. In operation, twisting lower body 805 with respect to upper body 803 allows one or more items to be dispensed through the compartment opening 830. In more detail, as the lower body 805 is twisted, and the compartment opening 830 aligns with a fixture 806 that contains an item, the storage compartment 800 is operable to dispense the item through the compartment opening 830 and into the environment.

In various implementations, any portion of the storage cups of FIG. 1A through FIG. 8B may be formed of metal, plastic, glass, or any other material suitable for the intended purpose of that portion. The body 205 of storage compartment 200 may be made of any material suitable for holding or storing an item such as a mint, a vitamin, a piece of candy, a piece of gum, or any other item that can fit into storage compartment 200; the divider 210 as well as its component parts (e.g., first part, second part) 202, 302 may be formed of any material suitable for coupling and creating a seal between storage compartment 200 and cup portion 300; the bottom 220 of storage compartment 200 may be formed of any material suitable to create a dividing barrier between storage compartment 200 and the exterior environment; the body 305 of cup portion 300 may be formed of any material suitable for holding or containing liquid or another substance within cup portion 30; the barrier 320 of cup portion 300 may be formed of any material suitable to create a dividing barrier between cup portion 300 and storage compartment 200; the lip 312 of cup portion 300 may be formed of any material suitable for coupling and creating a seal between the body 305 of cup portion 300 and the lid 310; the lid 310 may be formed of any material suitable for creating a dividing barrier between the body 305 of cup portion 300 and the exterior environment and the lid slider 313 may be formed of any material suitable for sliding across lid 310 in order to open or to seal close lid opening 311.

The body 405 of storage compartment 400 may be made of any material suitable for holding or storing an item such as a mint, a vitamin, a piece of candy, a piece of gum, or any other item that can fit into storage compartment 400; the divider 410 as well as its component parts (e.g., first part, second part, third part) 304, 404, 406 may be formed of any material suitable for coupling and creating a seal between storage compartment 400 and cup portion 300; and the bottom 420 of storage compartment 400 may be formed of any material suitable to create a dividing barrier between storage compartment 200 and the exterior environment.

The divider 510 may be formed of any material suitable for coupling and creating a seal between storage compartment 500 and cup portion 300; the body 505 of storage compartment 500 may be made of any material suitable for holding an interior chamber; the chamber wall 505 may be made of any material suitable for holding an interior chamber; the compartment divider 506 may be formed of any material suitable for providing a barrier between half compartments 512, 514; half compartments 512, 514 may be formed of any material suitable for holding or storing an item such as a mint, a vitamin, a piece of candy, a pill, or any other item that can fit into half compartments 512, 514; the hinge 504 may be made of any material suitable for rotating when the grip 508 is pushed exteriorly or internally; and the bottom 520 of storage compartment 500 may be formed of any material suitable to create a dividing barrier between storage compartment 500 and the exterior environment.

The body 605 of storage compartment 600 may be made of any material suitable for holding or storing an item such as a mint, a vitamin, a piece of candy, a piece of gum, or any other item that can fit into storage compartment 600; the divider 610 may be formed of any material suitable for coupling and creating a seal between storage compartment 600 and cup portion 300; the bottom 620 of storage compartment 600 may be formed of any material suitable to create a dividing barrier between storage compartment 600 and the exterior environment; the bottom 620 of storage compartment 600 may be made of any material suitable to couple sliding system 602 to the bottom of storage compartment 600; and sliding system 602 may be formed of any suitable material to create a track 604 for fastener 606 to slide along.

The body 705 of storage compartment 700 may be made of any material suitable for holding or storing an item such as a mint, a vitamin, a piece of candy, a piece of gum, or any other item that can fit into storage compartment 700; the divider 710 may be formed of any material suitable for coupling and creating a seal between storage compartment 700 and cup portion 300; the bottom 720 of storage compartment 700 may be formed of any material suitable to create a dividing barrier between storage compartment 700 and the exterior environment; the body 705 of storage compartment 700 may be made of any material suitable to couple sliding system 702 to the exterior of storage compartment 700; and sliding system 702 may be formed of any suitable material to create a track 704 for fastener 706 to slide along.

The rotating body 805 of storage compartment 800 may be made of any material suitable for holding or storing an item such as a mint, a vitamin, a piece of candy, or any other item that can fit into storage compartment 800; the divider 810 may be formed of any material suitable for coupling and creating a seal between storage compartment 800 and cup portion 300; the bottom 820 of storage compartment 800 may be formed of any material suitable to create a dividing barrier between storage compartment 800 and the exterior environment; and the gear 802, as well as it components 804, 806, may be formed of any material suitable to create a wheel that retrieves items from the interior of storage compartment 800 and brings the item to the exterior of storage compartment 800.

Figure 7B:
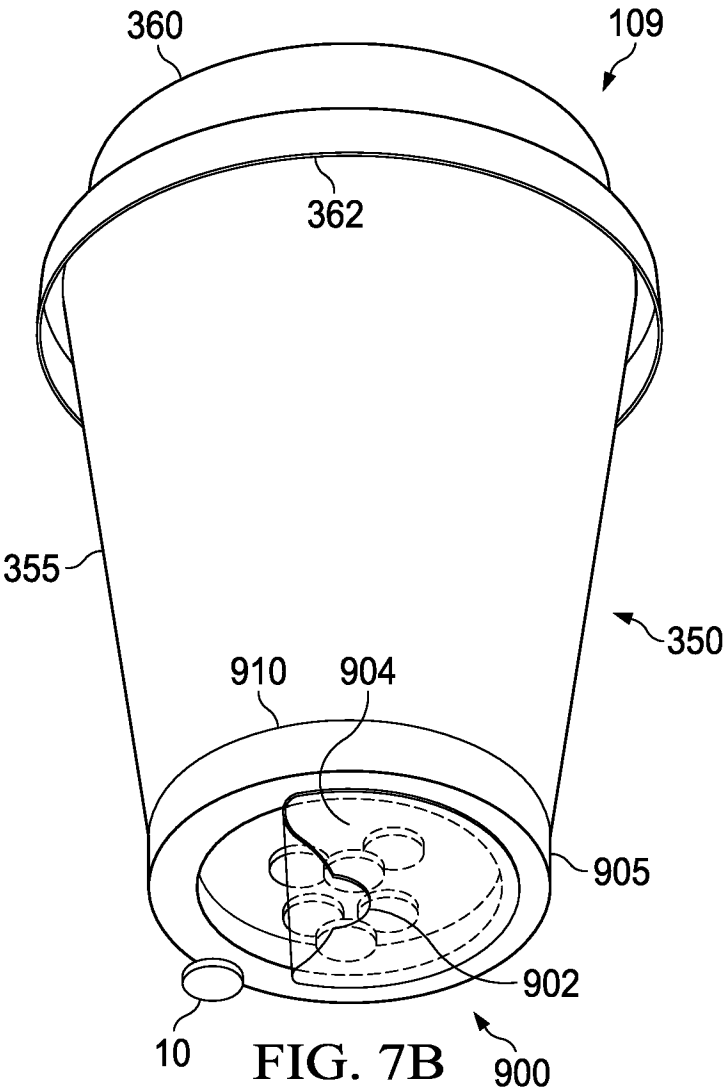
FIG. 7B illustrates the action of peeling the film layer from FIG. 7A back to expose a plurality of items within the compartment.
Figure 7A:
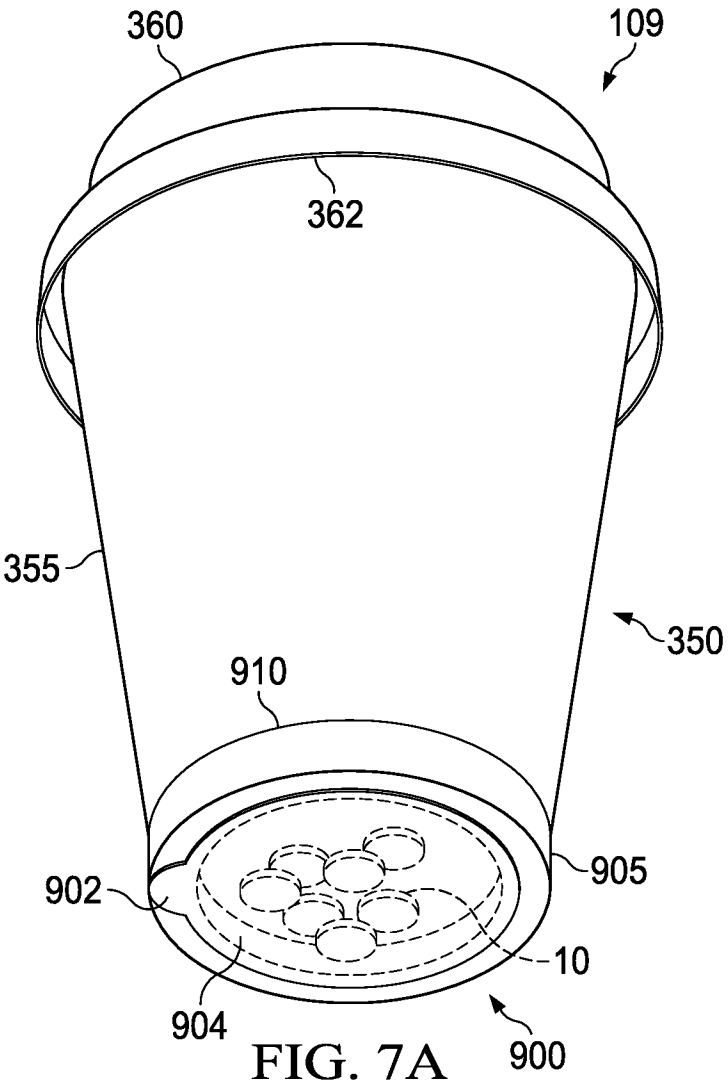
FIG. 7A illustrates a perspective view, looking upwardly from the bottom, of a disposable cup with a film layer that covers the compartment.

FIG. 7A and FIG. 7B illustrate perspective views of one implementation of a disposable storage cup 109, showing a storage compartment 900 of the storage cup 109 in a closed configuration and in an open configuration, respectively. In more detail, storage cup 109 comprises a generally disk-shaped storage compartment 900 at the bottom of the storage cup 109, and a cylindrical cup portion 350 disposed above the storage compartment 900. The storage compartment 900 couples to the cup portion 350 via a divider 910 operable to create a seal between the storage compartment 900 and the cup portion 350. Referring first to FIG. 7A, the storage compartment 900 comprises a generally disk-shaped body 905 coupled with a bottom film 904, which covers the compartment 900, operable to contain items 10 disposed within the storage compartment 900, as well as protect those items 10 from the outside environment. Furthermore, film 904 comprises tab 902 operable to uncouple film 904 from storage compartment 900. The cup portion 350 comprises a generally cylindrical body 355 operable for holding liquid or another substance separate from the storage compartment 900. The body 355 of the cup portion 350 further comprises a lip 362 at an upper portion thereof. In an implementation, the lip 362 couples with and forms a seal with an optional removable lid 360 for retaining liquid or other substance within the cup portion 350.

Referring now to FIG. 7B, a perspective view of the storage cup 109 of FIG. 9A is illustrated by showing the generally disk-shaped storage compartment 900 at the bottom of the storage cup 109 exposed to the environment when film 904 is uncoupled from storage compartment 900. As depicted, in this implementation, by pulling tab 902 away from compartment body 905, film 904 is uncoupled from storage compartment 900. Thus, exposing the interior of storage compartment 900 to the environment, and dispensing item 10.

Figure 8B:
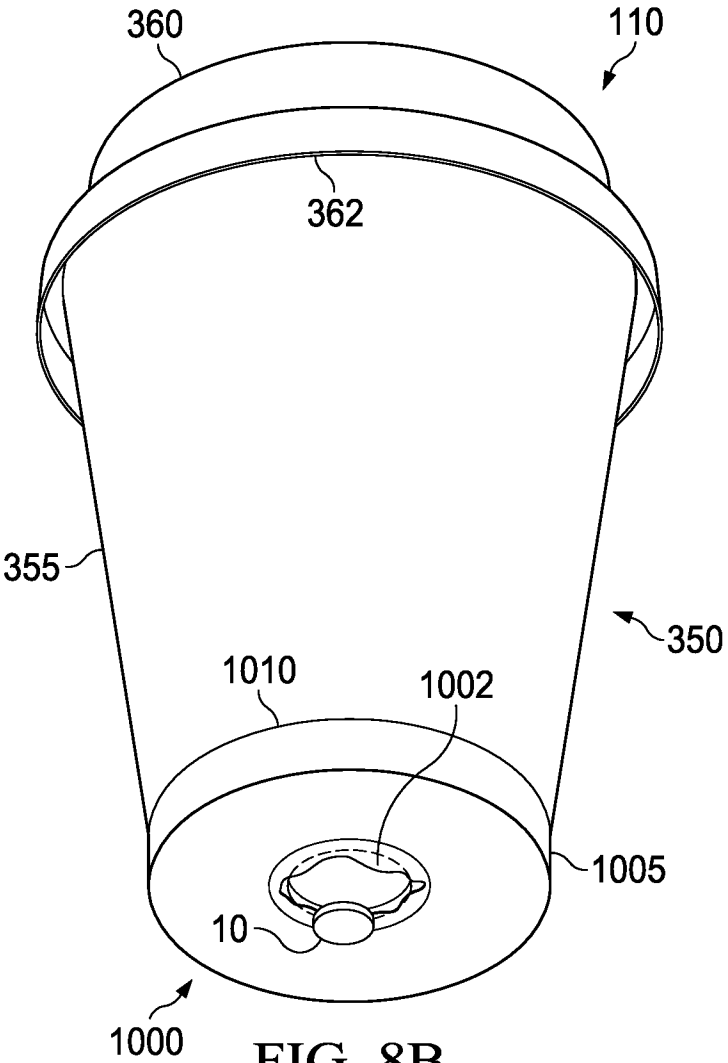
FIG. 8B illustrates the film from FIG. 3A after it has been punctured to expose the compartment.
Figure 8A:
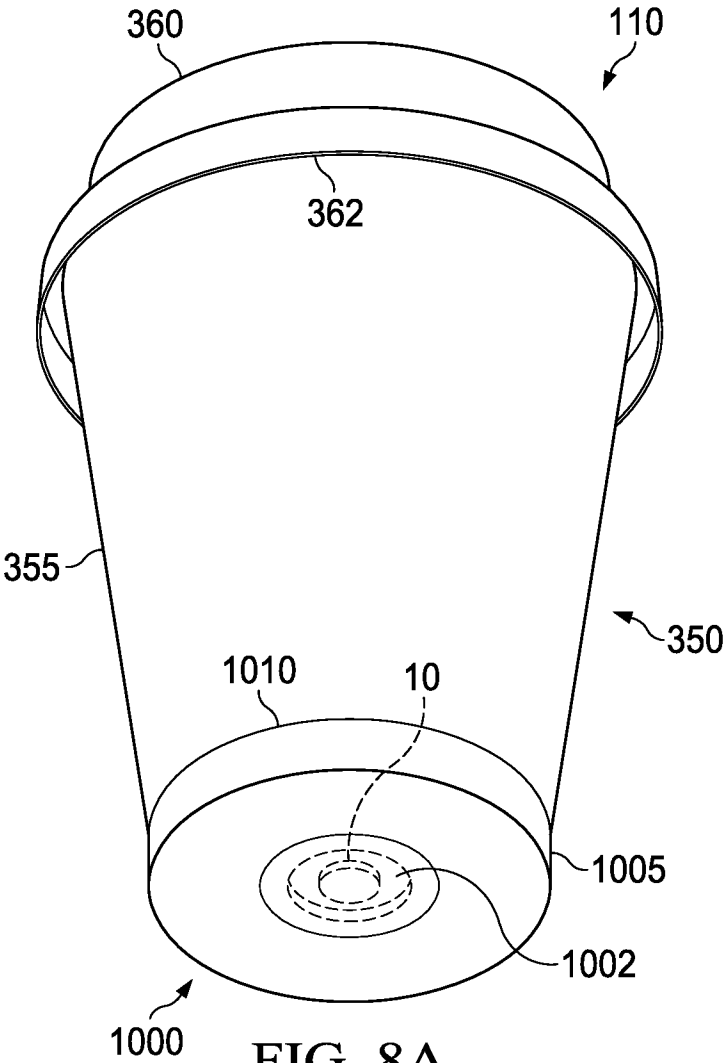
FIG. 8A illustrates a perspective view, looking upwardly from the bottom, of a disposable cup, which will have a small portion covered by a film.

FIG. 8A and FIG. 8B illustrate perspective views of another implementation of a disposable storage cup 110, showing a storage compartment 1000 in a closed configuration and in an open configuration, respectively. In more detail, storage cup 110 comprises a generally disk-shaped storage compartment 1000 at the bottom of the storage cup 110, and a cylindrical cup portion 350 disposed above the storage compartment 1000. The storage compartment 1000 couples to the cup portion 350 via a divider 1010 operable to create a seal between the storage compartment 1000 and the cup portion 350. Referring not to FIG. 8A, the storage cup 110 comprises a generally disk-shaped storage compartment 1000 at the bottom of the storage cup 110, wherein at least a portion of the storage compartment 1000 is enclosed by film 1002. Furthermore, film 1002 is operable to contain items 10 disposed within the storage compartment 1000, as well as protect those items 10 from the outside environment. Operationally, to move the body 1005 from the open configuration shown in FIG. 8B to the closed configuration shown in FIG. 10A, film 1002 must be puncture to expose compartment 1000 to the environment and dispense item 10.

In various implementations, any portion of the storage cups of FIG. 7A through FIG. 8B may be formed of paper, plastic, cardboard, or any other material suitable for the intended purpose of that portion. The body 905 of storage compartment 900 may be made of any material suitable for holding or storing an item such as a mint, a vitamin, a piece of candy, or any other item that can fit into storage compartment 900; the divider 910 may be formed of any material suitable for coupling and creating a seal between storage compartment 900 and cup portion 350; the bottom film 904, and its component tab 902, of storage compartment 900 may be formed of any material suitable to create a dividing barrier between storage compartment 900 and the exterior environment; the body 355 of cup portion 350 may be formed of any material suitable for holding or containing liquid or another substance within cup portion 350; the lip 362 of cup portion 350 may be formed of any material suitable for coupling and creating a seal between the body 355 of cup portion 350 and the lid 360; the lid 360 may be formed of any material suitable for creating a dividing barrier between the body 355 of cup portion 350 and the exterior environment.

The body 1005 of storage compartment 1000 may be made of any material suitable for holding or storing an item such as a mint, a vitamin, a piece of candy, or any other item that can fit into storage compartment 1000; the divider 1010 may be formed of any material suitable for coupling and creating a seal between storage compartment 1000 and cup portion 350; the bottom film 1002 of storage compartment 1000 may be formed of any material suitable to create a dividing barrier between storage compartment 1000 and the exterior environment.

The invention claimed is:

1. A device, comprising:

a cup portion having a cup body, a removable lid coupled to the cup portion, the lid defining a lid opening, wherein the lid opening exposes a liquid retained in the cup portion, wherein the lid comprises a lid slider movable to cover and uncover the lid opening, wherein the cup portion and lid are configured to retain a liquid in the cup portion;

a resealable storage compartment releasably coupled to the cup portion, the storage compartment comprising:

a shaped body, wherein the body is separable from the cup portion; and a bottom attached to the shaped body;

wherein the shaped body and bottom at least partially define a a storage space; and a divider configured to seal the storage compartment to the cup portion;

wherein the body of the storage compartment is resealable to the cup portion after separation from the cup portion.

2. The device of claim 1, wherein the body of the storage compartment is configured to reseal the cup portion multiple times.

3. The device of claim 1, wherein the storage compartment is detachable from the cup.

4. The device of claim 3, wherein the storage compartment is detached by unscrewing from the cup portion from the storage compartment and resealed by screwing the storage compartment to the cup portion.

5. The device of claim 3, wherein the divider has a first part arranged on the cup portion and a second part arranged on the storage compartment, wherein the storage compartment is releasably coupled to the cup portion by the divider;

wherein the divider is a resealable latch system.

6. The device of claim 1, wherein the storage compartment is coupled to the cup portion by a hinge; wherein the storage compartment is configured to pivot away from the cup portion via the hinge.

7. The device of claim 3, wherein the storage compartment defines an opening, wherein the opening is in communication with the storage space.

8. The device of claim 7, wherein the opening is defined in the bottom of the storage compartment or in the body of the storage compartment.

9. The device of claim 8, wherein the storage compartment further comprises a track system comprising:

a sliding or pivoting cover arranged on the storage compartment and configured to close or open the opening.

10. The device of claim 7, further comprising:

a spur comprising a plurality of teeth positioned inside the storage compartment and configured to secure an item within a storage space between two teeth, wherein the spur is rotatable relative to the storage compartment.

11. The device of claim 10, wherein the bottom of the storage compartment defines the opening, wherein the spur is configured to bring an item to the opening.

12. The device of claim 3, wherein the storage compartment defines an opening sized to dispense an item arranged in the storage space of the storage compartment.

13. The device of claim 12, further comprising at least one ingestible item, wherein the at least one ingestible item consists essentially of at least one of a mint, a pill, a vitamin, a piece of gum, a piece of candy, or a combination thereof.

14. The device of claim 12, wherein the body or bottom of the storage compartment defines the opening.

15. The device of claim 12, wherein the storage compartment comprises a track system, wherein the track system comprises:

a track defined in the body or the bottom of the storage compartment; and a fastener slidably attached to the track, wherein the fastener is configured to translate along the track to expose or cover the opening defined in the storge compartment.

16. The device of claim 3, wherein the cup portion comprises magnets, wherein the storage compartment comprises magnets, wherein the cup portion and storage portion are detachable and resealable by a magnetic connection between the magnets of the cup portion and the magnets of the storage compartment.

17. A storage cup system comprising:

a cup configured to retain a liquid, the cup comprising:

a cup body extending from a first portion of the cup to a second portion of the cup, a lip at the first portion of the cup, and a barrier arranged in the cup body at the second portion of the cup, a removable lid coupled to the lip of the cup, the removable lid having a lid opening and a movable lid slider arranged over the opening, wherein the movable lid slider is configured to expose the opening;

a resealable storage compartment releasably coupled to the second portion of the cup, wherein the storage compartment is separable from the cup and least partially defines a storage space; and at least one dispensable item disposed in the storage space, wherein the items comprise at least one of a mint, a pill, a vitamin, a piece of gum, and a piece of candy, wherein the storage compartment is configured to dispense the at least one item.

18. The system of claim 17, wherein the separable storage compartment is attached to the cup by threads, a latch system, magnets, or a combination thereof.

19. The system of claim 18, further comprising a divider configured to seal and reseal the storage compartment to the cup portion, wherein the divider comprises a first part arranged on the cup portion and a second part arranged on the storage compartment.

20. The system of claim 18, wherein the storage compartment is made of a material suitable to store the at least one dispensable item.

* * * * *